US006726785B2

(12) United States Patent
Oyama et al.

(10) Patent No.: US 6,726,785 B2
(45) **Date of Patent: *Apr. 27, 2004**

(54) ALUMINUM ALLOY SHEET MATERIAL AND METHOD FOR PRODUCING THE SAME

(75) Inventors: Koji Oyama, Tokyo (JP); Yoichiro Bekki, Tokyo (JP); Noboru Hayashi, Wako (JP); Morio Kuroki, Wako (JP)

(73) Assignees: The Furukawa Electric Co., Ltd., Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/151,062

(22) Filed: May 16, 2002

(65) Prior Publication Data

US 2003/0005984 A1 Jan. 9, 2003

(30) Foreign Application Priority Data

May 17, 2001 (JP) ..... 2001-148519

(51) Int. Cl.[7] ..... C22C 21/06

(52) U.S. Cl. ..... 148/439; 420/532; 420/535; 420/553

(58) Field of Search ..... 148/439; 420/532, 420/535, 553

(56) References Cited

U.S. PATENT DOCUMENTS

| | | | | |
|---|---|---|---|---|
| 4,126,486 A | | 11/1978 | Morris et al. | |
| 4,718,948 A | * | 1/1988 | Komatsubara et al. | 148/552 |
| 6,193,818 B1 | | 2/2001 | Legresy et al. | |
| 6,325,870 B1 | * | 12/2001 | Kashiwazaki et al. | 148/439 |
| 6,355,090 B1 | * | 3/2002 | Ohyama et al. | 75/687 |
| 6,440,583 B1 | * | 8/2002 | Ueno et al. | 428/654 |

FOREIGN PATENT DOCUMENTS

| | | | | |
|---|---|---|---|---|
| EP | 1 108 798 A2 | | 6/2001 | |
| EP | 1 108 798 A3 | | 12/2001 | |
| JP | 2000-303134 | | 10/2000 | |
| JP | 2000-131933 | | 11/2000 | |
| JP | 2000-319740 | | 11/2000 | |
| JP | 2001-162318 | | 6/2001 | |
| WO | WO 99/23266 | | 5/1999 | |
| WO | WO 99/53110 | | 10/1999 | |
| WO | WO 9953110 A1 | * | 10/1999 | C22C/1/02 |
| WO | WO 99/60181 | | 11/1999 | |
| WO | WO 9960181 A1 | * | 11/1999 | C22C/21/02 |

OTHER PUBLICATIONS

Co–pending Application No. 09/978,063, filed Oct. 17, 2001.

Co–pending Application No. 09/331,966, filed Aug. 6, 1999.

Co–pending Application No. 09/783,048, filed Dec. 15, 2000.

Catrin Kammer, "Aluminium–Taschenbuch Band 1", ('1995) Aluminium –Zentrale XP002206883 pp. 213–215 and 229–233.

Co–pending Application No. 10/210,856 field Jul. 30,2002.

Catrin Kammer, "Aluminum–Taschenbuch Band 1", (1995) Aluminum–Zentrale XP002206883 pp. 213–215 and 229–233.

Catrin Kammer, "Aluminum–Taschenbuch Band 1", (1995) Aluminum–Zentrale XP002206883 pp. 222–226.

* cited by examiner

*Primary Examiner*—George Wyszomierski
*Assistant Examiner*—Janelle Combs Morillo
(74) *Attorney, Agent, or Firm*—Knobbe Martens Olson & Bear LLP

(57) ABSTRACT

An aluminum alloy sheet material, containing 2.6% by mass or more and less than 3.5% by mass (% by mass is simply denoted by % hereinafter) of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and containing, if necessary, at least one of 0.01 to 0.2% of Cr, 0.01 to 0.2% of Zr, 0.01 to 0.2% of V, and 0.01 to 0.2% of Ti, with the balance of Al and unavoidable impurities. A method of producing the aluminum alloy sheet material, which method contains carrying out specific workings.

20 Claims, No Drawings

ALUMINUM ALLOY SHEET MATERIAL AND METHOD FOR PRODUCING THE SAME

FIELD

The present invention relates to an aluminum alloy sheet material and a method for producing the same.

BACKGROUND

Wrought materials using an aluminum alloy are used in many fields by taking advantage of its lighter weight as compared with steel materials. For example, in recent years, automobiles are desired to be light weight for reducing the amount of exhaust gases (to prevent environmental pollution) and for improving fuel efficiencies, considering the effect on global environments. For attaining the above objective, use of an aluminum alloy is being investigated. It is thought that sheet materials using an aluminum alloy are able to be applied for various sheet members, such as outer materials including a hood and a door, or inner materials of automobiles, and that they can greatly contribute for making the body of the automobile lightweight.

Aluminum alloys of 5000-series and 6000-series are representative materials that have been conventionally used for such the aluminum alloy sheet material for automobiles. However, there are such problems for applying these alloy sheet materials for the automobile that they are a little inferior in mechanical strength to steel materials even by taking hardening after baking into consideration, that cracks are liable to occur in forming with a press and the like due to inferior formability to other materials including steel materials, and that the material is broken at a bending portion formed by hem-bending to bend the periphery of the sheet material when it is used as an outer material. Since impurity contents of these alloys are strictly prescribed, a virgin ingot of aluminum and mother alloys containing various kinds of additive elements should be blended as raw materials for producing the sheet material. Accordingly, it is difficult to use aluminum alloy scraps or secondary ingots and the like that are supplied from markets and contain a rather large amount of impurities, for applying to these sheet materials by re-melting them as they are, rendering them difficult for recycling.

SUMMARY

The present invention is an aluminum alloy sheet material, which comprises 2.6% by mass or more and less than 3.5% by mass of Si (% by mass is simply denoted by % hereinafter), 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises, if necessary, at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities.

Further, the present invention is a method for producing an aluminum alloy sheet material, which method comprises:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises, if necessary, at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities;

hot-rolling the cast aluminum alloy after applying homogenizing treatment;

cold-rolling the rolled aluminum alloy, to form a sheet thereof with a prescribed thickness; and subjecting the sheet to heat-treatment by holding the sheet at a temperature of 450° C. or more for a time period of 120 seconds or less, and cooling to a temperature of 100° C. or less at a cooling speed of 100° C./min or more;

wherein, with respect to the aluminum alloy sheet material, tensile strength and 0.2% proof stress, when they are represented by T (MPa) and Y (MPa), respectively, satisfy conditions as shown by the following formula:

$$T^2/Y \geqq 350.$$

Further, the present invention is a method for producing an aluminum alloy sheet material, which method comprises:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises, if necessary, at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities;

hot-rolling the cast aluminum alloy after applying homogenizing treatment;

cold-rolling the rolled aluminum alloy, to form a sheet thereof with a prescribed thickness; and subjecting the sheet to heat-treatment by holding the sheet at a temperature of 300° C. or more and 420° C. or less for a time period of 30 minutes or more, and cooling to room temperature at a cooling rate of 60° C./min or less;

wherein, with respect to the aluminum alloy sheet material, 0.2% proof stress is 100 MPa or less.

Further, the present invention is a method for producing an aluminum alloy sheet material, which method comprises:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises, if necessary, at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities, wherein a cooling rate for solidifying a molten liquid is adjusted to 50° C./sec or more by continuous cast-rolling, in the melting and casting step.

Other and further features and advantages of the invention will appear more fully from the following description.

DETAILED DESCRIPTION

According to the present invention, there is provided the following means:

(1) An aluminum alloy sheet material, comprising 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities;

(2) The aluminum alloy sheet material described in item (1), further containing a component originating from scraps of an aluminum alloy in at least a part of the sheet material;

(3) The aluminum alloy sheet material described in item (1) or (2), wherein concentrations of Si, Mn and Fe, when they are represented by A%, B% and C%, respectively, satisfy conditions as shown by the following formula:

$$(0.015\times A+0.15\times B+0.03\times C)\leqq 0.445, \text{ and}$$

wherein a density of precipitates with an average diameter of 100 $\mu$m or more is 2 precipitates/cm$^2$ or less;

(4) The aluminum alloy sheet material described in item (1), (2) or (3), wherein tensile strength and 0.2% proof stress, when they are represented by T (MPa) and Y (MPa), respectively, satisfy conditions as shown by the following formula:

$$T^2/Y\geqq 350;$$

(5) The aluminum alloy sheet material described in item (1), (2) or (3), wherein 0.2% proof stress is 100 MPa or less;

(6) The aluminum alloy sheet material described in item (1), (2) or (3), wherein 0.2% proof stress after baking of a coating is higher by 30 MPa or more than 0.2% proof stress before baking;

(7) A method for producing the aluminum alloy sheet material described in item (4), comprising:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities;

hot-rolling the cast aluminum alloy after applying homogenizing treatment;

cold-rolling the rolled aluminum alloy, to form a sheet thereof with a prescribed thickness; and subjecting the sheet to heat-treatment by holding the sheet at a temperature of 450° C. or more for a time period of 120 seconds or less, and cooling to a temperature of 100° C. or less at a cooling speed of 100° C./min or more;

(8) A method for producing the aluminum alloy sheet material described in (5) comprising:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities;

hot-rolling the cast aluminum alloy after applying homogenizing treatment;

cold-rolling the rolled aluminum alloy, to form a sheet thereof with a prescribed thickness; and subjecting the sheet to heat-treatment by holding the sheet at a temperature of 300° C. or more and 420° C. or less for a time period of 30 minutes or more, and cooling to room temperature at a cooling rate of 60° C./min or less;

(9) A method for producing the aluminum alloy sheet material described in (1) or (2), comprising:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities, wherein a cooling rate for solidifying a molten liquid is adjusted to 50° C./sec or more by continuous cast-rolling, in the melting and casting step;

(10) An aluminum alloy sheet material, comprising 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and comprising at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities;

(11) The aluminum alloy sheet material described in item (10), further containing a component originating from scraps of an aluminum alloy in at least a part of the sheet material;

(12) The aluminum alloy sheet material described in item (10) or (11), wherein concentrations of Si, Mn, Fe, Cr, Zr and Ti, when they are represented by A%, B%, C%, D%, E% and F%, respectively, satisfy conditions as shown by the following formula:

$$\{0.015\times A+0.15\times B+0.03\times C+0.60\times(D+E)+0.50\times F\}\leqq 0.445, \text{ and}$$

wherein a density of precipitates with an average diameter of 100 $\mu$m or more is 2 precipitates/cm$^2$ or less;

(13) The aluminum alloy sheet material described in item (10), (11) or (12), wherein tensile strength and 0.2% proof stress, when they are represented by T (MPa) and Y (MPa), respectively, satisfy conditions as shown by the following formula:

$$T^2/Y\geqq 350;$$

(14) The aluminum alloy sheet material described in item (10), (11) or (12), wherein 0.2% proof stress is 100 MPa or less;

(15) The aluminum alloy sheet material described in item (10), (11) or (12), wherein 0.2% proof stress after baking of a coating is higher by 30 MPa or more than 0.2% proof stress before baking;

(16) A method for producing the aluminum alloy sheet material described in item (13), comprising:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities;

hot-rolling the cast aluminum alloy after applying homogenizing treatment;

cold-rolling the rolled aluminum alloy, to form a sheet thereof with a prescribed thickness; and subjecting the sheet to heat-treatment by holding the sheet at a temperature of 450° C. or more for a time period of 120 seconds or less, and cooling to a temperature of 100° C. or less at a cooling speed of 100° C./min or more;

(17) A method for producing the aluminum alloy sheet material described in (14) comprising:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities;

hot-rolling the cast aluminum alloy after applying homogenizing treatment;

cold-rolling the rolled aluminum alloy, to form a sheet thereof with a prescribed thickness; and subjecting the sheet to heat-treatment by holding the sheet at a temperature of 300° C. or more and 420° C. or less for a time period of 30 minutes or more, and cooling to room temperature at a cooling rate of 60° C./min or less; and

(18) A method for producing the aluminum alloy sheet material described in (10) or (11), comprising:

melting and casting an aluminum alloy which comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and which comprises at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities, wherein a cooling rate for solidifying a molten liquid is adjusted to 50° C./sec or more by continuous cast-rolling, in the melting and casting step.

The function of each element in the aluminum alloy according to the present invention will be described below.

The aluminum alloy according to the present invention comprises 2.6% or more and less than 3.5% of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and comprises, if necessary, at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities. The function of each element will be described hereinafter.

Si is an element that forms an intermetallic compound $Mg_2Si$ to contribute in enhancing the mechanical strength when it coexists with Mg. Si that forms a solid solution after melt-treatment, forms a β-phase by conformed precipitation together with Mg after the subsequent baking, and also contributes in improving the mechanical strength after baking. However, these effects cannot be fully obtained when the content of Si is less than 2.6%. On the other hand, these effects are saturated when the content is 3.5% or more, in addition to reducing bending property when the content of Si is too large, since the amount of elementary Si or intermetallic compounds containing Si that serves as breakage initiation points during forming becomes too large. Accordingly, the content of Si is 2.6% or more and less than 3.5%, preferably in the range of 2.8 to 3.2%. The upper limit of the Si content as high as infinitely close to 3.5% may contribute to efficient recycling of the alloy according to the present invention. That is, in the recycling process of aluminum alloy scraps having a high content of Si, application fields that can use the high Si-content aluminum alloy as it is are quite restricted. As a result, the scraps have been usually used as oxygen scavengers in the producing process of steels or scrapped as they are, except when the scraps are used by diluting with a large quantity of virgin ingots or they are used as a part of alloys for castings. However, the permissible range of the Si content in the alloy according to the present invention is so wide that it is possible to use the scraps as they are that have been impossible to use as a wrought material in the currently applicable standard of alloys, thereby enabling the aluminum alloy to be subjected to closed recycling.

Mg contributes to enhancing the mechanical strength by forming $Mg_2Si$ as has been described with respect to Si. In addition, Mg in a solid solution also contributes to enhancing the mechanical strength after baking, by forming a β-phase with Si by baking. This effect cannot be fully exhibited when the amount of addition of Mg is less than 0.05%, while a content of more than 0.5% only results in saturation of the strength improving effect. Accordingly, the content of Mg is 0.05 to 0.5%, preferably 0.1 to 0.4%.

Cu exerts a strength enhancing effect by forming a solid solution in a matrix, as well as a formability improving effect of the sheet material. A too small content of Cu makes these effects insufficient, while too much content of Cu allows these effects to be saturated while deteriorating casting ability to make manufacture of the ingot difficult. Accordingly, the content of Cu is 0.5% or more and less than 1.2%, preferably in the range of 0.62 to 1.1%, more preferably 0.65 to 1.1%, and most preferably in the range of 0.7 to 1.1%.

Mn also serves for enhancing the mechanical strength. This effect becomes insufficient when the Mn content is too small, while formability decreases when the content of Mn is too large since giant precipitates of Al—Mn or Al—Mn—Si—Fe compounds are occurred that serve as breakage initiation points during the forming process. Accordingly, the content of Mn is 0.6 to 1.5%, and preferably 0.7 to 1.2%.

Zn is also an element effective for improving the mechanical strength and maintaining the mechanical strength after coating/baking. This effect becomes insufficient when the content of Zn is too small, while the effect is saturated when the content of Zn is too large. Accordingly, the content of Zn is 0.5 to 1.6%, preferably in the range of 0.7 to 1.2%.

Fe has a function for improving toughness by making the crystal grain fine. This effect becomes insufficient when the content of Fe is too small, while workability decreases when the content of Fe is too large due to occurrence of giant precipitates. Accordingly, the content of Fe is 0.3 to 2.0%, preferably in the range of 0.6 to 1.2%.

Adding an element selected from Cr, Zr, V and Ti makes toughness of the resulting alloy to be improved by forming fine crystalline grains. For example, impact energy absorbing property is improved by adding at least one of these elements in the alloy sheet material to be used as an automobile frame member, thereby contributing to protection of drivers and walkers, and the like. However, in the case of adding at least one of the these elements, these effects are insufficient when the amount of addition of these elements is too small, while toughness decreases, on the contrary, when the amount of addition is too large because these elements form coarse intermetallic compounds with aluminum. Therefore, the preferable amount of addition of these elements is as described in the above.

When further improvement in press-formability, such as drawing property, stretch-forming property and bending property, are desirable in the present invention, it is preferable that the concentrations of Si, Mn and Fe, as represented by A%, B% and C%, respectively, satisfy conditions of the following formula:

$$(0.015\times A+0.15\times B+0.03\times C)\leqq 0.445 \quad (1)$$

or that, the concentrations of Si, Mn, Fe, Cr, Zr and Ti, as represented by A%, B%, C%, D%, E% and F%, respectively, satisfy conditions of the following formula:

$$\{0.015\times A+0.15\times B+0.03\times C+0.60\times(D+E)+0.50\times F\}\leqq 0.445 \quad (2),$$

in addition to adjusting the composition range of each element above. When the concentrations of Si, Mn and Fe, and if necessary the concentrations of Cr, Zr and Ti do not satisfy the conditions of the formulas above, a large quantity of coarse intermetallic compounds containing these elements as constituting components are precipitated during the casting step. This coarse intermetallic compound persists in final products as it is, without any changes during the producing process. When the final sheet material contains a large quantity of such intermetallic compounds, they serve as initiation pints of breakage in the press forming and bending, to deteriorate press-formability and bending property. Accordingly, in the present invention, the concentrations of Si, Mn and Fe, and if necessary the concentrations of Cr, Zr and Ti are preferably in the range satisfying the conditions of any one of the formulas described above. Furthermore, the density of the precipitates with an average grain diameter of 100 $\mu$m or more existing in the sheet material, is preferably to be 2 precipitates/cm$^2$ or less. The sheet material becomes susceptible to breakage and press formability or bending property is deteriorated, when the density of the precipitates having the average diameter of 100 $\mu$m or more is higher than 2 precipitates/cm$^2$. Therefore, the density of the precipitates with an average diameter of 100 $\mu$m or more is preferably to be 2 precipitates/cm$^2$ or less.

Since the aluminum alloy according to the present invention can contain large quantities of Si, Mn, Zn and Cu, scraps of various aluminum alloys may be used as raw materials of the aluminum alloy according to the present invention by recycling. No particular restrictions are necessary to be provided for the scraps to be used. For example, use can be made of various scraps obtained in machining processes, such as scraps of aluminum cans (UBC), scraps of aluminum sashes, scraps of structural materials of automobiles, and other scraps of aluminum sheet products and scraps of aluminum extrusion products. In particular, since a variety of aluminum alloy members, such as castings and wrought materials, are used in automobiles, they can be subjected to closed recycling for automobile materials, by adjusting the aluminum alloy scraps originating from automobiles to have a composition range according to the present invention, and by using the aluminum alloy obtained therefrom as sheet materials for automobiles.

In the present invention, when it is desirable to further improve the drawing property, among various press-forming properties, the tensile strength and the 0.2% proof stress, as represented by T MPa and Y MPa, respectively, preferably satisfy conditions of the following formula (3):

$$T^2/Y \geq 350.$$

When this correlation formula between the tensile strength and the 0.2% proof stress is satisfied, a sufficient forming height can be obtained, by making flow of the molten alloy into the flange part easy in drawing with a press, since a sufficient mechanical strength of the material is secured. The effective producing method that satisfies the conditions of the formula comprises the steps of: melting and casting the aluminum alloy having the foregoing composition; hot-rolling the alloy after applying homogenizing treatment; cold-rolling the alloy, to form a sheet thereof with a prescribed thickness; and subjecting the sheet to heat-treatment of holding the sheet at a temperature of 450° C. or more for a time period of 120 seconds or less and then cooling the sheet to a temperature of 100° C. or less at a cooling rate of 100° C./min or more. While the upper limit of the cooling rate is not particularly restricted, it is generally 150° C./sec or less. The lower limit of the holding time is also not restricted particularly, and the sheet may be cooled immediately after reaching the desired heat-treatment temperature. The preferable upper limit of the heat treatment temperature is 555° C. or less, in order to attain a sufficient supersaturating concentration of each element in the solid solution that contributes to improvement in mechanical strength, or to obtain a sufficient mechanical strength that satisfies the above formula. When the holding temperature is too low or the cooling rate is too low, an improvement in drawing property may not be expected with an insufficient mechanical strength in some cases, since sufficient supersaturating concentration in the solid solution cannot be obtained. When the holding time is longer than 120 seconds, the supersaturating concentration in the solid solution is saturated, to merely result in low productivity. Accordingly, the producing conditions as described above are preferably applied for further improving drawing property in the present invention.

In the present invention, after the above-mentioned heat-treatment, a heat-treatment for holding the aluminum alloy sheet at a temperature of 250° C. or less for a time period of 120 seconds or less can be applied, as a stabilization treatment (a restoration treatment) for reducing the change of mechanical strength of the product with the lapse of time.

In the present invention, the 0.2% proof stress can be increased by applying baking finish after machining into automobile members under the conditions as described above. This increase of the proof strength enables the aluminum alloy sheet material according to the present invention to be applied to frame members that require high mechanical strength that cannot be attained by conventional aluminum alloys.

In the present invention, when it is desirable to further improve the bending property and stretch forming property, the 0.2% proof stress is to be 100 MPa or less. The difference between the matrix strength and grain boundary strength (the strength influenced by grain boundary precipitation or non-precipitation zones) is reduced when the 0.2% proof stress is 100 MPa or less, thereby reducing stress concentration on grain boundaries during forming, to enable a sufficient elongation required for forming to be ensured. Consequently, a sufficient forming height can be secured in stretch forming, and edges with good outer appearance can be obtained in bending without rough surfaces ascribed to local deformation in the vicinity of grain boundaries with no occurrence of cracks. The producing method that satisfies the above conditions comprises the steps of: melting and casting the aluminum alloy having the forgoing composition; hot-rolling the cast alloy after applying homogenizing treatment; cold-rolling the rolled alloy, to form a sheet of the alloy with a prescribed thickness; and subjecting the sheet to heat treatment of holding the sheet at a temperature of 300° C. or more and 420° C. or less for a time period of 30 minutes or more and then cooling the sheet to room temperature at a cooling rate of 60° C./min or less. When the holding temperature is too low, or the holding time is too short, or the cooling rate is too fast, sufficient drawing property and stretch-forming property may not be obtained in some cases.

Further, in the present invention, it is also possible to improve formability by adjusting the cooling rate in the solidifying of a molten liquid at 50° C./min or more by a continuous cast-rolling method, when melting and casting the aluminum alloy having the foregoing composition. In other words, by making the molten liquid to be quenched in the above manner, giant intermetallic compounds may be prevented from precipitating even when the relation among the concentrations of Si, Mn, Fe, Cr, Zr and Ti, as represented by A%, B%, C%, D%, E% and F%, respectively, do not necessarily satisfy the conditions of the formula (1) or (2) above, thereby permitting breakage by forming ascribed to the giant intermetallic compounds to be avoided. In addition, the cast sheet thus-obtained has an average length of the dendrite arm spacing (DAS) of 18 $\mu$m or less. Since the proportion of segregation in the material becomes smaller as DAS is shorter, a more uniform structure of the alloy can be obtained. This effect becomes larger at the cooling rate of 50° C./sec or more during solidification by the continuous cast-rolling method, and a cooling rate lower then the rate above does not contribute to the improvement of formability. Accordingly, the cooling rate is generally 50° C./sec or more, preferably 60° C./sec or more. Specifically, this cooling rate can be attained by using a twin-roll, belt or block type continuous cast-rolling machine.

The aluminum alloy sheet material according to the present invention is excellent in mechanical strength, drawing property, stretch-forming property, bending property, and hardness after baking. The aluminum alloy sheet material enables wide range of aluminum alloy scraps to be used as raw materials for producing the sheet material, while being excellent in applicability for recycling and being able to suppress the producing energy cost. The present invention makes it possible to produce the aluminum alloy sheet material that is particularly preferable for use in automobiles with low cost, by improving press-formability, bending property and stretch forming property.

Further, the aluminum alloy sheet material of the present invention is improved, particularly, in press-formability (drawing property, stretch-forming property, bending property, and the like).

Further, the aluminum alloy sheet material of the present invention is improved, particularly, in bending property and stretch-forming property.

The present invention will be described in more detail based on the example below, but the invention is not limited to those.

EXAMPLES

Table 2 shows chemical compositions of aluminum alloys to be used in the following examples according to the present invention and comparative examples. Based on these compositions, an aluminum ingot, and mother alloys of magnesium, zinc and other elements, or scraps of an aluminum alloy were appropriately mixed and melted, and the molten liquid was formed into an ingot with a thickness of 500 mm by a DC (Direct Chill) casting process. When it is difficult to form a molten (liquid) metal using the aluminum alloy scraps as they are, a reclaimed ingot manufactured by previously melting and reclaiming the scrap alone may be used. A continuous cast-roll coil was separately produced by the twin-roll process by increasing the cooling rate of the molten metal. Aluminum alloys of the compositions corresponding to JIS 5052 and JIS 6061, respectively, were prepared, as comparative examples. The values corresponding to the Cr equivalence for each composition as determined by the following formula are also shown in Table 2:

$$\text{Cr equivalence}=(0.015\times A+0.15\times B+0.03\times C),$$

or $$\text{Cr equivalence}=\{0.015\times A+0.15\times B+0.03\times C+0.60\times(D+E)+0.50\times F\},$$

wherein A, B, C, D, E and F denote the concentrations of Si, Mn, Fe, Cr, Zr and Ti, respectively in mass % unit.

The scrap of the alloy that was used in the mark D in the example according to the present invention corresponds to the scrap of a casting for machines (including those for use in automobiles) having the composition shown in Table 1.

The proportion to be used of the scrap of alloys was adjusted to be about 70 percent of the total mass, and the remaining part was adjusted with a virgin ingot and mother alloys of each element.

TABLE 1

| Chemical composition of scrap of castings for machines (mass %) | | | | | | | | | | |
|---|---|---|---|---|---|---|---|---|---|---|
| Si | Mg | Cu | Mn | Zn | Fe | Cr | Zr | V | Ti | Al |
| 5.9 | 0.2 | 1.4 | 1.1 | 1.7 | 2.0 | 0.05 or less | | | | balance |

The cast ingot by the DC casting was subjected to homogenizing treatment, and then the resulting ingot was formed into a sheet with a thickness of 3 mm by hot-rolling. Then, by cold-rolling the sheet, a rolled sheet with a final thickness of 1 mm was produced. The continuous cast coil was formed into a rolled sheet with a final thickness of 1 mm by cold-rolling. These rolled sheets were heat-treated under the conditions described in Table 3. As shown in Table 3, a part of the materials were subjected to another heat-treatment corresponding to baking finish at 180° C. for 30 minutes, in order to confirm the degree of hardening by baking.

The samples No. 6 and 8 in the sheet materials according to the present invention were cooled to room temperature at a cooling rate of 50° C./min after holding the cold-rolled sheet at 400° C. for 120 minutes.

The samples No. 1, 2, 3, 4, 5, 7, 9, 10 and 11 of the sheet materials according to the present invention were subjected to heat treatment of the cold-rolled sheet, by keeping at a temperature of 500° C. for 15 seconds, followed by cooling to a temperature of 100° C. or less at a cooling speed of 180° C./min. Other samples were heat-treated under the conditions shown in Table 3.

Characteristics of the thus-obtained sheet materials as described above were measured under the conditions below.

{Tensile Test}

The tensile strength, 0.2% proof stress and elongation were determined at a tensile speed of 10 mm/min using JIS No. 5 test pieces and an Instron type tensile tester. Each test sample was sampled in the directions of 0°, 90° and 45° C. along the roll direction, and a mean value was calculated by averaging the measured values along the respective directions.

{Drawing Test}Each sheet was blanked with a diameter of 85 mm, and was drawn into a cylinder by applying a wrinkling press force of 3,000 kgf. The height immediately after breakage by this test was measured, to define the forming height by drawing.

{Stretch-forming Test}

The sheet material was fixed with a wrinkling press provided with a lock bead, and was subjected to a stretching test using a spherical punch with a diameter of 50 mm. The height immediately after breakage was measured by this test, which was defined as a forming height by stretch forming.

{Bending Test}

The sheet material was processed into a JIS No. 3 bending test piece, which was subjected to 180° and 90° bending tests, separately. The test results were evaluated as best results (◎) when no cracks were occurred in the 180° and 90° bending tests, as good (○) when cracks were not occurred only in the 90° bending test, and as poor (x) when cracks were occurred in both of the bending tests.

It was confirmed from microscopic observations of the samples No. 1 to 30 shown in Table 3 that the precipitate density with an average diameter of 100 $\mu$m or more was 2 precipitates/cm$^2$ or less in all the examples (Nos. 1 to 11) according to the present invention, while the density was 3 precipitates/cm$^2$ in Comparative example Nos. 18, 20 and 25 and 4 precipitates/cm$^2$ in Nos. 22 and 26.

The results obtained in the foregoing test methods are listed in Table 3.

TABLE 2

| | Mark | Si | Mg | Cu | Mn | Zn | Fe | Cr | Zr | V | Ti | Al | Cr Equivalence※ | (Unit of Concentration: mass %) Note |
|---|---|---|---|---|---|---|---|---|---|---|---|---|---|---|
| Example according to this invention | A | 2.70 | 0.08 | 0.60 | 0.65 | 0.60 | 0.33 | — | — | — | — | Balance | 0.148 | |
| | B | 3.10 | 0.30 | 0.80 | 0.95 | 1.00 | 0.65 | 0.05 | 0.03 | — | 0.10 | Balance | 0.307 | |
| | C | 3.20 | 0.35 | 1.10 | 1.14 | 1.40 | 1.20 | 0.10 | — | 0.06 | 0.08 | Balance | 0.355 | |
| | D | 3.44 | 0.46 | 1.12 | 0.90 | 1.55 | 1.80 | 0.03 | 0.16 | 0.17 | 0.17 | Balance | 0.440 | Scraps of an aluminum alloy was used |
| Comparative example | A1 | 3.34 | 0.45 | 0.62 | 0.62 | 0.65 | 0.78 | 0.02 | — | — | 0.02 | Balance | 0.189 | |
| | A2 | 3.35 | 0.44 | 0.65 | 0.62 | 0.66 | 0.77 | 0.03 | — | — | 0.02 | Balance | 0.194 | |
| | A3 | 3.35 | 0.45 | 0.70 | 0.62 | 0.66 | 0.77 | 0.02 | — | — | 0.01 | Balance | 0.183 | |
| | E | 2.45 | 0.30 | 0.70 | 0.80 | 0.80 | 0.60 | 0.17 | 0.02 | — | 0.10 | Balance | 0.339 | |
| | F | 3.71 | 0.29 | 0.82 | 1.00 | 1.10 | 0.80 | — | — | — | 0.03 | Balance | 0.245 | |
| | G | 3.01 | 0.03 | 0.75 | 0.95 | 0.91 | 0.65 | — | — | 0.05 | — | Balance | 0.207 | |
| | H | 2.92 | 0.28 | 0.41 | 1.01 | 0.95 | 1.00 | 0.05 | — | 0.10 | 0.03 | Balance | 0.270 | |
| | I | 3.11 | 0.30 | 1.30 | 0.90 | 1.00 | 0.85 | — | 0.10 | — | 0.05 | Balance | 0.292 | |
| | J | 3.03 | 0.27 | 0.77 | 0.45 | 0.80 | 1.02 | — | — | — | 0.10 | Balance | 0.194 | |
| | K | 3.21 | 0.32 | 0.81 | 1.70 | 1.11 | 0.80 | — | — | — | — | Balance | 0.327 | |
| | L | 2.97 | 0.31 | 0.80 | 0.88 | 0.35 | 0.60 | — | 0.03 | — | 0.18 | Balance | 0.303 | |
| | M | 3.20 | 0.27 | 0.83 | 0.95 | 0.70 | 0.15 | 0.12 | 0.16 | 0.15 | 0.10 | Balance | 0.413 | |
| | N | 2.95 | 0.25 | 0.90 | 0.91 | 0.80 | 2.30 | 0.05 | 0.05 | 0.05 | — | Balance | 0.310 | |
| | O | 3.40 | 0.44 | 1.10 | 1.12 | 1.50 | 1.81 | 0.17 | 0.01 | 0.17 | 0.15 | Balance | 0.456 | |
| | P | 0.70 | 1.01 | 0.30 | 0.10 | 0.14 | 0.29 | — | — | 0.01 | 0.03 | Balance | 0.049 | Corresponding to JIS6061 |
| | Q | 0.21 | 2.51 | 0.04 | 0.04 | 0.05 | 0.31 | 0.17 | — | 0.01 | 0.02 | Balance | 0.130 | Corresponding to JIS5052 |
| | R | 3.27 | 0.42 | 1.00 | 1.12 | 1.45 | 1.78 | 0.16 | 0.01 | 0.16 | 0.16 | Balance | 0.452 | |
| | S | 3.40 | 0.42 | 0.60 | 1.15 | 1.40 | 1.77 | 0.18 | 0.01 | 0.15 | 0.15 | Balance | 0.466 | |
| | U | 2.70 | 0.40 | 0.70 | 0.52 | 0.20 | 0.65 | 0.05 | 0.03 | 0.03 | 0.03 | Balance | 0.201 | |
| | V | 2.68 | 0.42 | 1.30 | 0.53 | 0.58 | 0.60 | 0.06 | 0.02 | 0.02 | 0.03 | Balance | 0.201 | |
| | W | 2.82 | 0.36 | 0.85 | 0.59 | 1.02 | 0.80 | 0.03 | — | — | 0.02 | Balance | 0.183 | |
| | X | 3.00 | 0.5 | 0.63 | 0.46 | 1.1 | 0.85 | 0.06 | — | — | 0.02 | Balance | 0.186 | |

※The Cr equivalence was calculated by the following formula:

Cr Equivalence = (0.015 × A + 0.15 × B + 0.03 × C), or

Cr Equivalence = {0.015 × A + 0.15 × B + 0.03 × C + 0.60 × (D + E) + 0.50 × F } wherein A, B, C, D, E and F denote the concentrations of Si, Mn, Fe, Cr, Zr and Ti, respectively.

TABLE 3

| | | | Producing Conditions | | | | | | | | Tensile Test | | | | | | | |
|---|---|---|---|---|---|---|---|---|---|---|---|---|---|---|---|---|---|---|
| | | | | | Heat Treatment | | | | Restoration Treatment | | | | | | | | | |
| | | Mark of Alloy | Casting | | Heating | Holding | | | Holding | | Tensile | 0.2% Proof | 0.2% Proof Stress | | | Forming Height (mm) | | |
| | Sample No. | to be used | Cooling Rate (° C./sec.) | DAS (μm) | Tempera-ture (° C./min.) | Tempera-ture (° C.) | Holding Time (min.) | Cooling rate (° C./min.) | Tempera-ture (° C.) | Holding Time (min.) | Strength [T] (MPa) | Stress [Y] (MPa) | after Baking (MPa) | Elonga-tion (%) | $T^2/Y$ | Drawing | Stretch Forming | Bending property |
| Example according to this invention | 1 | A | 8 | 30 | 180 | 500 | 0.25 | 180 | — | — | 200 | 105 | — | 22.5 | 381 | 9.5 | 12.5 | ○ |
| | 2 | B | 8 | 30 | 180 | 500 | 0.25 | 180 | — | — | 240 | 130 | — | 22.0 | 443 | 10.0 | 12.0 | ○ |
| | 3 | C | 8 | 30 | 180 | 500 | 0.25 | 180 | — | — | 250 | 140 | — | 21.0 | 446 | 11.0 | 12.0 | ○ |
| | 4 | D | 8 | 30 | 180 | 500 | 0.25 | 180 | 200 | 0.5 | 270 | 155 | 190 | 20.0 | 470 | 11.5 | 11.5 | ○ |
| | 5 | B | 8 | 30 | 180 | 500 | 0.25 | 180 | — | — | 240 | 130 | 165 | 22.0 | 443 | 10.0 | 12.0 | ○ |
| | 6 | B | 8 | 30 | 50 | 400 | 120 | 50 | — | — | 155 | 85 | — | 26.0 | 283 | 8.5 | 14.0 | ◎ |
| | 7 | B | 200 | 5 | 180 | 500 | 0.25 | 180 | — | — | 280 | 165 | — | 22.5 | 475 | 12.0 | 13.0 | ○ |
| | 8 | B | 200 | 5 | 50 | 400 | 120 | 50 | — | — | 160 | 90 | — | 27.0 | 284 | 9.0 | 15.0 | ◎ |
| | 9 | A1 | 8 | 30 | 180 | 500 | 0.25 | 180 | — | — | 255 | 140 | — | 21.5 | 464 | 11.0 | 12.0 | ○ |
| | 10 | A2 | 8 | 30 | 180 | 500 | 0.25 | 180 | — | — | 260 | 143 | — | 23.0 | 473 | 12.0 | 12.5 | ○ |
| | 11 | A3 | 8 | 30 | 180 | 500 | 0.25 | 180 | — | — | 267 | 150 | — | 24.0 | 475 | 12.5 | 13.5 | ◎ |
| Comparative Example | 12 | E | 8 | 30 | 180 | 500 | 0.25 | 180 | 200 | 0.5 | 190 | 100 | — | 20.0 | 361 | 9.0 | 9.5 | ○ |
| | 13 | F | 8 | 30 | 180 | 500 | 0.25 | 180 | — | — | 180 | 130 | — | 12.0 | 249 | 6.0 | 7.5 | X |
| | 14 | G | 8 | 30 | 180 | 500 | 0.25 | 180 | — | — | 185 | 90 | — | 20.0 | 380 | 8.5 | 11.0 | ○ |
| | 15 | H | 8 | 30 | 180 | 500 | 0.25 | 180 | — | — | 200 | 100 | — | 19.0 | 400 | 9.0 | 9.0 | X |
| | 16 | I | Casting was impossible | | | | | | | | | | | | | | | |
| | 17 | J | 8 | 30 | 180 | 500 | 0.25 | 180 | — | — | 205 | 100 | — | 20.0 | 420 | 9.0 | 9.5 | ○ |
| | 18 | K | 8 | 30 | 180 | 500 | 0.25 | 180 | — | — | 230 | 130 | — | 17.0 | 407 | 10.0 | 7.0 | X |
| | 19 | L | 8 | 30 | 180 | 500 | 0.25 | 180 | — | — | 195 | 95 | — | 20.0 | 400 | 9.0 | 9.0 | X |
| | 20 | M | 8 | 30 | 180 | 500 | 0.25 | 180 | — | — | 180 | 95 | — | 21.0 | 341 | 7.0 | 10.0 | ○ |
| | 21 | N | 8 | 30 | 180 | 500 | 0.25 | 180 | — | — | 235 | 140 | — | 16.0 | 394 | 10.0 | 7.0 | X |
| | 22 | O | 8 | 30 | 180 | 500 | 0.25 | 180 | — | — | 250 | 160 | — | 17.0 | 391 | 6.0 | 5.5 | X |
| | 23 | P | 8 | 30 | 180 | 500 | 0.25 | 180 | 200 | 0.5 | 240 | 150 | 25 | 22.0 | 384 | 10.0 | 8.5 | ○ |
| | 24 | Q | 8 | 30 | 180 | 400 | 120 | 50 | — | — | 200 | 90 | — | 26.0 | 444 | 8.5 | 12.0 | ◎ |
| | 25 | R | 8 | 30 | 180 | 500 | 0.25 | 180 | — | — | 270 | 160 | — | 16.0 | 456 | 10.0 | 6.0 | X |
| | 26 | S | 8 | 30 | 180 | 500 | 0.25 | 180 | — | — | 280 | 165 | — | 16.5 | 475 | 11.0 | 6.0 | X |
| | 27 | U | 8 | 30 | 180 | 500 | 0.25 | 180 | — | — | 190 | 90 | — | 19.0 | 401 | 9.0 | 8.5 | ○ |
| | 28 | V | 8 | 30 | 180 | 500 | 0.25 | 180 | — | — | 280 | 170 | — | 19.0 | 461 | 9.5 | 8.5 | X |
| | 29 | W | 8 | 30 | 180 | 500 | 0.25 | 180 | — | — | 190 | 95 | — | 20.0 | 380 | 9.0 | 8.0 | ○ |
| | 30 | X | 8 | 30 | 180 | 500 | 0.25 | 180 | — | — | 195 | 100 | — | 20.0 | 380 | 9.0 | 8.0 | ○ |

Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy sheet material, consisting of 2.6% by mass or more and less than 3.5% by mass (% by mass is simply denoted by % hereinafter) of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities, and wherein the 0.2% proof stress is 100 MPa or less.

2. The aluminum alloy sheet material according to claim 1, further containing a component originating from scraps of an aluminum alloy in at least a part of the sheet material.

3. The aluminum alloy sheet material according to claim 1, wherein concentrations of Si, Mn and Fe, when they are represented by A%, B% and C%, respectively, satisfy conditions as shown by the following formula:

$$(0.015\times A+0.15\times B+0.03\times C)\leqq 0.445, \text{ and}$$

wherein a density of precipitates with an average diameter of 100 $\mu$m or more is 2 precipitates/cm$^2$ or less.

4. The aluminum alloy sheet material according to claim 1, wherein tensile strength and 0.2% proof stress, when they are represented by T (MPa) and Y (MPa), respectively, satisfy conditions as shown by the following formula:

$$T^2/Y\geqq 350.$$

5. The aluminum alloy sheet material according to claim 1, wherein 0.2% proof stress after baking of a coating is higher by 30 MPa or more than 0.2% proof stress before baking.

6. An aluminum alloy sheet material, comprising 2.6% by mass or more and less than 3.5% by mass of Si, 0.05 to 0.5% of Mg, 0.5% or more and less than 1.2% of Cu, 0.6 to 1.5% of Mn, 0.5 to 1.6% of Zn, and 0.3 to 2.0% of Fe, and comprising at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities, and wherein said aluminum alloy sheet material has been heat treated to have a 0.2% proof stress is 100 Mpa or less.

7. The aluminum alloy sheet material according to claim 6, further containing a component originating from scraps of an aluminum alloy in at least a part of the sheet material.

8. The aluminum alloy sheet material according to claim 6, wherein concentrations of Si, Mn, Fe, Cr, Zr and Ti, when they are represented by A%, B%, C%, D%, E% and F%, respectively, satisfy conditions as shown by the following formula:

$$\{0.015\times A+0.15\times B+0.03\times C+0.60\times(D+E)+0.50\times F\}\leqq 0.445, \text{ and}$$

wherein a density of precipitates with an average diameter of 100 $\mu$m or more is 2 precipitates/cm$^2$ or less.

9. The aluminum alloy sheet material according to claim 6, wherein tensile strength and 0.2% proof stress, when they are represented by T (MPa) and Y (MPa), respectively, satisfy conditions as shown by the following formula:

$$T^2/Y\geqq 350.$$

10. The aluminum alloy sheet material according to claim 6, wherein 0.2% proof stress after baking of a coating is higher by 30 MPa or more than 0.2% proof stress before baking.

11. An aluminum alloy sheet material, consisting essentially of 2.6% by mass or more and less than 3.5% by mass of Si, 0.05 to 0.5% of Mg, 0.5% or more and less than 1.2% of Cu, 0.6 to 1.5% of Mn, 0.5 to 1.6% of Zn, 0.3 to 2.0% of Fe, and at least one selected from the group consisting of 0.01 to 0.2% of Cr, 0.01 to 0.2% of Zr, 0.01 to 0.2% of V, and 0.01 to 0.2% of Ti, with the balance of Al and unavoidable impurities, wherein concentrations of Si, Mn, Fe, Cr, Zr and Ti, when they are represented by A%, B%, C%, D%, E% and F%, respectively, satisfy conditions as shown by the following formula:

$$\{0.015\times A+0.15\times B+0.03\times C+0.60\times(D+E)+0.50\times F\}\leqq 0.445, \text{ and}$$

wherein a density of precipitates with an average diameter of 100 $\mu$m or more is 2 precipitates/cm$^2$ or less, wherein 0.2% proof stress is 100 MPa or less, and wherein the aluminum alloy sheet material is for use in automobiles.

12. The aluminum alloy sheet material according to claim 11, further containing a component originating from scraps of an aluminum alloy in at least a part of the sheet material.

13. The aluminum alloy sheet material according to claim 11, wherein 0.2% proof stress after baking of a coating is higher by 30 MPa or more than 0.2% proof stress before baking.

14. The aluminum alloy sheet material according to claim 11, wherein the scraps of an aluminum alloy are scraps of aluminum castings.

15. An automobile material, which is prepared from the aluminum sheet materials according to claim 11.

16. The sheet material of claim 11, wherein the forming height by stretch forming is 12 mm or more and less than 14 mm.

17. An aluminum alloy sheet material, comprising 2.6% by mass or more and less than 3.5% by mass of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities, wherein concentrations of Si, Mn and Fe, when they are represented by A%, B% and C%, respectively, satisfy conditions as shown by the following formula:

$$(0.015\times A+0.15\times B+0.03\times C)\leqq 0.445,$$

wherein a density of precipitates with an average diameter of 100 $\mu$m or more is 2 precipitates/cm$^2$ or less, wherein 0.2% proof stress is 100 MPa or less, and wherein the aluminum alloy sheet material is for use in automobiles.

18. A The aluminum alloy sheet material according to claim 17, wherein tensile strength and 0.2% proof stress, when they are represented by T (MPa) and Y (MPa), respectively, satisfy conditions as shown by the following formula:

$$T^2/Y\geqq 350.$$

19. The sheet material of claim 17, wherein the forming height by stretch forming is 12 mm or more and less than 14 mm.

20. An aluminum alloy sheet material, consisting of 2.6% by mass or more and less than 3.5% by mass (% by mass is simply denoted by % hereinafter) of Si, 0.05 to 0.5% of Mg, 0.5% or more and less than 1.2% of Cu, 0.6 to 1.5% of Mn, 0.5 to 1.6% of Zn, and 0.3 to 2.0% of Fe, with the balance of Al and unavoidable impurities, wherein the 0.2% proof stress is 100 MPa or less;

wherein concentrations of Si, Mn and Fe, when they are represented by A%, B% and C%, respectively, satisfy conditions as shown by the following formula:

$$(0.015\times A+0.15\times B+0.03\times C)\leqq 0.445, \text{ and}$$

wherein a density of precipitates with an average diameter of 100 $\mu$m or more is 2 precipitates/cm$^2$ or less;

wherein tensile strength and 0.2% proof stress, when they are represented by T (MPa) and Y (MPa), respectively, satisfy conditions as shown by the following formula:

$$T^2/Y\geqq 350; \text{ and}$$

wherein a forming height by stretch forming is 14 to 15 mm.

* * * * *